US012369766B2

(12) United States Patent
Lu

(10) Patent No.: US 12,369,766 B2
(45) Date of Patent: Jul. 29, 2025

(54) BLOCKING PLUG AND INTELLIGENT CLEANING DEVICE

(71) Applicant: Beijing Roborock Technology Co., Ltd., Beijing (CN)

(72) Inventor: Youcheng Lu, Beijing (CN)

(73) Assignee: Beijing Roborock Technology Co., Ltd., Beijing (CN)

( * ) Notice: Subject to any disclaimer, the term of this patent is extended or adjusted under 35 U.S.C. 154(b) by 583 days.

(21) Appl. No.: 17/640,804

(22) PCT Filed: Aug. 13, 2020

(86) PCT No.: PCT/CN2020/108883

§ 371 (c)(1),
(2) Date: Mar. 4, 2022

(87) PCT Pub. No.: WO2021/042958

PCT Pub. Date: Mar. 11, 2021

(65) Prior Publication Data

US 2022/0313051 A1 Oct. 6, 2022

(30) Foreign Application Priority Data

Sep. 5, 2019 (CN) ..... 201921478012.X

(51) Int. Cl.
*A47L 11/40* (2006.01)
*A47L 11/24* (2006.01)
(Continued)

(52) U.S. Cl.
CPC ..... *A47L 11/4083* (2013.01); *A47L 11/24* (2013.01); *B65D 25/40* (2013.01); *B65D 47/00* (2013.01)

(58) Field of Classification Search
CPC .. A47L 11/4083; A47L 11/24; A47L 2201/00; A47L 11/28; A47L 11/4002;
(Continued)

(56) References Cited

U.S. PATENT DOCUMENTS 3,305,135 A * 2/1967 Lemoine ..... B67D 1/0829 222/90
5,215,129 A * 6/1993 Berresford ..... B67D 1/04 141/66
(Continued)

FOREIGN PATENT DOCUMENTS

CN 105662280 A * 6/2016
CN 206724396 U * 12/2017
(Continued)

OTHER PUBLICATIONS

Communication from European Application No. 20861471.9 dated Aug. 11, 2023.
(Continued)

*Primary Examiner* — Donnell A Long
(74) *Attorney, Agent, or Firm* — Calfee, Halter & Griswold LLP

(57) ABSTRACT

The present disclosure relates to a blockage and a smart cleaning device. The blockage includes a plug body and a hierarchical sealing structure. The plug body is a shaft-shaped structure as a whole, and is provided with a through hole that penetrates the plug body. The hierarchical sealing structure is sleeved on an outer side of the plug body, and is provided with at least two annular plugs stacked in an axial direction of the plug body.

15 Claims, 18 Drawing Sheets

(51) Int. Cl.
*B65D 25/40* (2006.01)
*B65D 47/00* (2006.01)

(58) Field of Classification Search
CPC . A47L 11/4036; A47L 11/4061; B65D 25/40; B65D 47/00; B65D 25/42; B65D 25/48
See application file for complete search history.

(56) References Cited

U.S. PATENT DOCUMENTS 6,595,109 B2 * 7/2003 Liebmann, Jr. ..... C12H 1/14 261/DIG. 7
2002/0120364 A1 * 8/2002 Colens ..... G05D 1/0242 700/262
2004/0049877 A1 * 3/2004 Jones ..... A47L 9/009 15/319
2007/0157415 A1 * 7/2007 Lee ..... A47L 9/2873 15/319
2007/0157416 A1 * 7/2007 Lee ..... A47L 9/2894 15/328
2007/0157420 A1 * 7/2007 Lee ..... A47L 5/28 15/328
2007/0199612 A1 * 8/2007 Larimer ..... B65D 81/2038 141/65
2007/0266508 A1 * 11/2007 Jones ..... A47L 9/2894 15/49.1
2008/0127445 A1 * 6/2008 Konandreas ..... A47L 11/302 901/1
2008/0272085 A1 * 11/2008 Laporta ..... B65D 39/0064 215/358
2009/0228165 A1 * 9/2009 Ozick ..... A47L 9/0488 320/137
2010/0011529 A1 * 1/2010 Won ..... A47L 11/4066 15/21.1
2010/0125968 A1 * 5/2010 Ho ..... A47L 5/00 15/319
2011/0126939 A1 * 6/2011 Luis ..... B65B 31/047 141/98
2012/0167917 A1 * 7/2012 Gilbert, Jr. ..... A47L 11/408 134/6
2012/0180254 A1 * 7/2012 Morse ..... A47L 11/4069 15/345
2013/0206170 A1 * 8/2013 Svendsen ..... G05D 1/0225 15/384
2014/0184144 A1 7/2014 Henricksen et al.
2014/0312000 A1 * 10/2014 Xu ..... B65D 51/244 215/228
2015/0217912 A1 8/2015 Luzaich
2017/0129631 A1 5/2017 Crisp

FOREIGN PATENT DOCUMENTS

CN 108443512 A 8/2018
CN 108852185 A 11/2018
CN 210931186 U 7/2020
WO 2011/014790 A1 2/2011
WO 2018/137408 A1 8/2018
WO WO-2020092859 A1 * 5/2020

OTHER PUBLICATIONS

PCT, International Search Report for PCT/CN2020/108883, Nov. 2, 2020.

* cited by examiner

A-A

B-B

BLOCKING PLUG AND INTELLIGENT CLEANING DEVICE

CROSS-REFERENCE TO RELATED APPLICATIONS

This application is a United States national phase of a Patent Cooperation Treaty (PCT) application PCT/CN2020/108883 filed on Aug. 13, 2020, which claims priority to Chinese Patent Application No. 201921478012.X filed on Sep. 5, 2019. Priority to the preceding patent applications is expressly claimed, and the disclosures of the preceding applications are hereby incorporated herein by reference in their entireties and for all purposes.

TECHNICAL FIELD

The present disclosure relates to the field of smart cleaning device technologies, and in particular, to a blockage and a smart cleaning device.

BACKGROUND

With the development of technologies, various automatic cleaning devices appear, for example, automatic sweeping robots and automatic mopping robots. The automatic cleaning devices can automatically perform a cleaning operation, which is convenient for users. For example, the automatic sweeping robot automatically cleans a to-be-swept region through direct scraping, vacuum cleaning, or the like. The scraping operation can be performed using a scraper and rolling brush structure at the bottom of the automatic cleaning device. The automatic sweeping robot with a mopping function usually has a water tank inside to provide a water source needed for mopping.

A water outlet of the water tank of the existing automatic sweeping robot often encounters water leakage, the sealing effect is not good, and the mounting is inconvenient.

SUMMARY

Embodiments of the present disclosure provide a blockage and a smart cleaning device.

According to an aspect, embodiments of the present disclosure provide a blockage, including: a plug body, where the plug body is a shaft-shaped structure as a whole, and is provided with a through hole that penetrates the plug body; and a hierarchical sealing structure, where the hierarchical sealing structure is sleeved on an outer side of the plug body, and is provided with at least two annular plugs stacked in an axial direction of the plug body.

According to an aspect of the embodiments of the present disclosure, an outer diameter of an annular plug of the two adjacent annular plugs near an end of the plug body is smaller than an outer diameter of an annular plug of the two adjacent annular plugs away from the end of the plug body; and/or in the axial direction of the plug body, a thickness of an annular plug of the two adjacent annular plugs near an end of the plug body is smaller than a thickness of an annular plug of the two adjacent annular plugs away from the end of the plug body.

According to an aspect of the embodiments of the present disclosure, the at least two annular plugs are arranged at intervals in the axial direction of the plug body.

According to an aspect of the embodiments of the present disclosure, a shape of a curved surface formed jointly by outer side walls of the at least two annular plugs is the same as a shape of a side surface of a circular truncated cone.

According to an aspect of the embodiments of the present disclosure, the plug body is provided with a first retaining wall and a second retaining wall, the first retaining wall and the second retaining wall are arranged at intervals in the axial direction of the plug body, and the hierarchical sealing structure is sandwiched between the first retaining wall and the second retaining wall, so that the first retaining wall and the second retaining wall can define relative positions of the hierarchical sealing structure and the plug body in the axial direction of the plug body.

According to an aspect of the embodiments of the present disclosure, two ends of the hierarchical sealing structure in its own axial direction have two opposite end faces, and the two end faces are respectively arranged against the first retaining wall and the second retaining wall.

According to an aspect of the embodiments of the present disclosure, the hierarchical sealing structure has an annular inner wall surrounding the plug body, and the annular inner wall is fixedly connected to the plug body.

According to an aspect of the embodiments of the present disclosure, the through hole is a through hole that penetrates the plug body in the axial direction of the plug body, the blockage is configured to block a water outlet of the liquid holding tank of the smart cleaning device, and liquid in the liquid holding tank can flow out of the liquid holding tank through the through hole.

According to another aspect, embodiments of the present disclosure provide a smart cleaning device, including: a machine body; a cleaning assembly, where the cleaning assembly is detachably connected to the machine body, and includes a liquid holding tank, a connecting plate, and a flexible cleaning body that are stacked; and the liquid holding tank is detachably connected to the machine body, the connecting plate is detachably connected to the liquid holding tank, and the flexible cleaning body is detachably connected to the connecting plate; and the foregoing blockage, where the liquid holding tank is provided with a water outlet, the blockage is arranged corresponding to the water outlet and is configured to block the water outlet, and liquid in the liquid holding tank can flow out of the liquid holding tank through the through hole.

According to another aspect of the embodiments of the present disclosure, the plug body includes a blocking section and a connecting section that are connected to each other, the hierarchical sealing structure is sleeved on an outer side of the blocking section, the blocking section and the hierarchical sealing structure can be placed in the water outlet, the hierarchical sealing structure forms an interference fit with the water outlet, and the connecting section is connected to the machine body.

The embodiments of the present disclosure provide the blockage and the smart cleaning device. The blockage includes a plug body and a hierarchical sealing structure. The plug body is a shaft-shaped structure as a whole, and is provided with a through hole that penetrates the plug body. The hierarchical sealing structure is sleeved on an outer side of the plug body, and is provided with at least two annular plugs stacked in an axial direction of the plug body. The blockage has a good blocking effect on a liquid holding tank of the smart cleaning device, and therefore can avoid liquid leakage in the liquid holding tank. In addition, the blockage is conveniently mounted.

BRIEF DESCRIPTION OF THE DRAWINGS

The following describes the features, advantages, and technical effects of example embodiments of the present disclosure with reference to the accompanying drawings. It should be noted that the figures are not necessarily drawn to scale and that elements of similar structures or functions are generally represented by like reference numerals for illustrative purposes throughout the figures. It also should be noted that the figures are only intended to facilitate the description of the preferred embodiments. The figures do not illustrate every aspect of the described embodiments and do not limit the scope of the present disclosure.

In the drawings.

Figure 1:
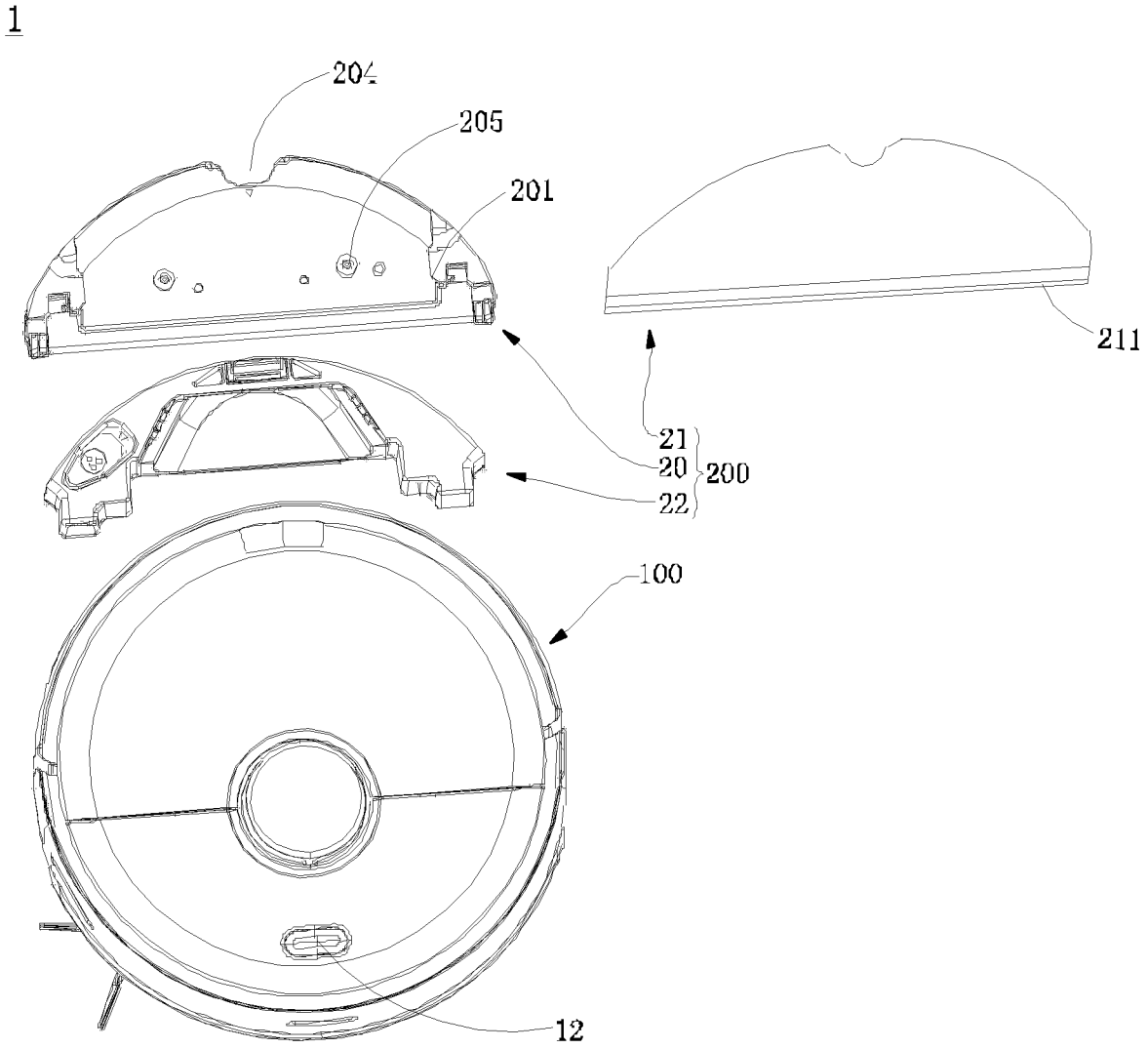
FIG. 1 is an exploded view of a smart cleaning device according to some embodiments of the present disclosure.

1: smart sweeping robot;

100: machine body;

10: driving system; 101: driving wheel module; 102: driven wheel;

11: cliff sensor;

12: man-machine interaction system;

13: dry cleaning portion; 131: rolling brush; 132: side brush;

14: forward portion;

15: backward portion;

16: fan mounting position;

200: cleaning assembly;

20: supporting plate; 201: guide protrusion; 202: second hook; 203: mounting groove; 204: notch; 205: elastic part; 206: water passage hole; 207: mounting port;

21: cleaning cloth; 211: guide bar;

22: water tank; 221: guide groove; 222: first hook; 223: water outlet;

23: control structure; 231: mounting bracket; 232: operating part;

24: button;

25: reversed return waterway board; 251: water outlet port;

300: blockage;

30: plug body; 301: through hole; 302: first retaining wall; 303: second retaining wall;

31: hierarchical sealing structure; 311: annular plug; 312: annular inner wall.

In the drawings, identical parts use identical reference numerals. The drawings are not drawn to actual scale.

DETAILED DESCRIPTION OF THE PREFERRED EMBODIMENTS

The following describes in detail the features and example embodiments of various aspects of the present disclosure. The following detailed description provides many specific details to facilitate a comprehensive understanding of the technical solutions provided in the embodiments of the present disclosure. However, it is obvious to a person skilled in the art that, the technical solutions provided in the embodiments of the present disclosure can be implemented without some of these specific details. The embodiments are described below only to provide a better understanding of the present disclosure by showing examples of the present disclosure. In the accompanying drawings and the following descriptions, at least some of the well-known structures and technologies are omitted, so as not to unnecessarily obscure the present disclosure; in addition, for the sake of clarity, sizes of some structures may be exaggerated. In addition, the features, structures, or characteristics described below can be combined in one or more embodiments in any suitable manner.

The orientation words appearing in the following descriptions are all directions shown in the figures, and are not intended to limit specific structures of a blockage 300 and a smart cleaning device provided in the embodiments of the present disclosure. In the descriptions of the embodiments of the present disclosure, it should be further noted that, unless otherwise specified and limited explicitly, the terms "mounting" and "connection" should be understood in a broad sense, for example, may be fixed connection, detachable connection, or integrated connection; or may be direct connection or indirect connection. A person of ordinary skill in the art can understand specific meanings of the foregoing terms in the embodiments of the present disclosure depending on a specific case.

According to a smart cleaning device provided in the embodiments of the present disclosure, every time a flexible cleaning body is to be replaced, a liquid holding tank does not need to be removed, and the flexible cleaning body can be removed only when a connecting plate is removed in a forward or backward direction of a machine body. This is convenient for operation and can avoid damage to the smart cleaning device that is easily caused by removing the liquid holding tank.

To better understand the present disclosure, the following describes in detail the smart cleaning device and a cleaning assembly 200 according to the embodiments of the present disclosure with reference to FIG. 1 to FIG. 12.

Figure 2:
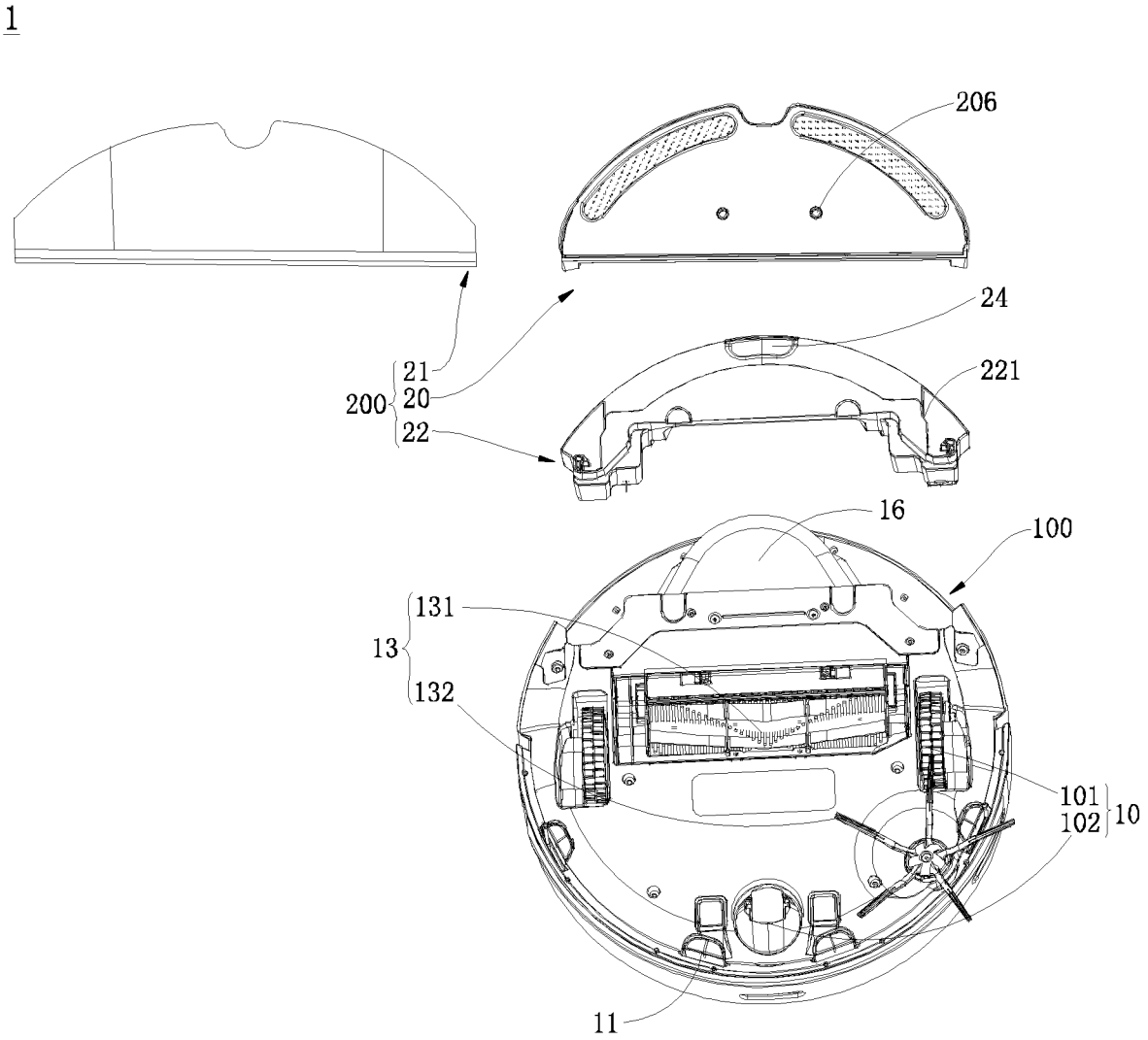
FIG. 2 is an exploded view of a smart cleaning device from another perspective according to some embodiments of the present disclosure.
Figure 3:
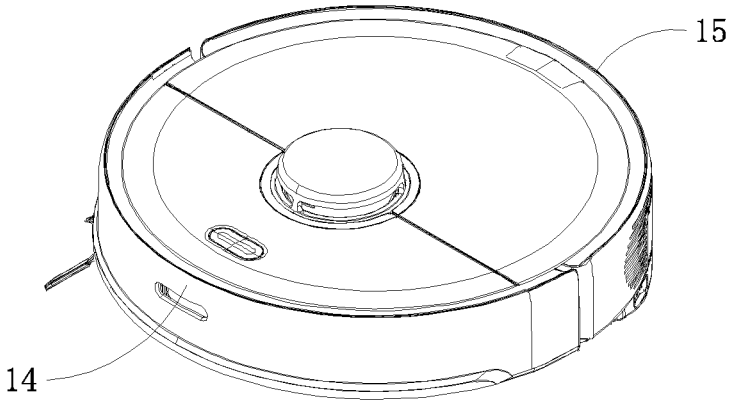
FIG. 3 is an axonometric view of a smart cleaning device according to some embodiments of the present disclosure.
Figure 4:
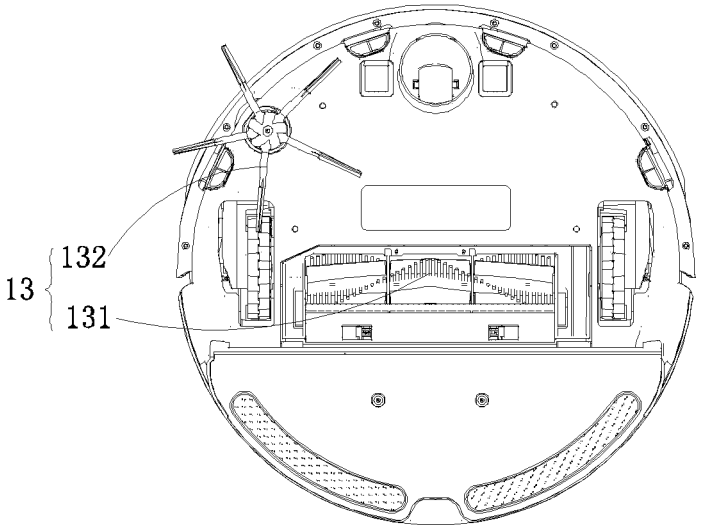
FIG. 4 is an axonometric view of a smart cleaning device from another perspective after a flexible cleaning body is removed according to some embodiments of the present disclosure.
Figure 5:
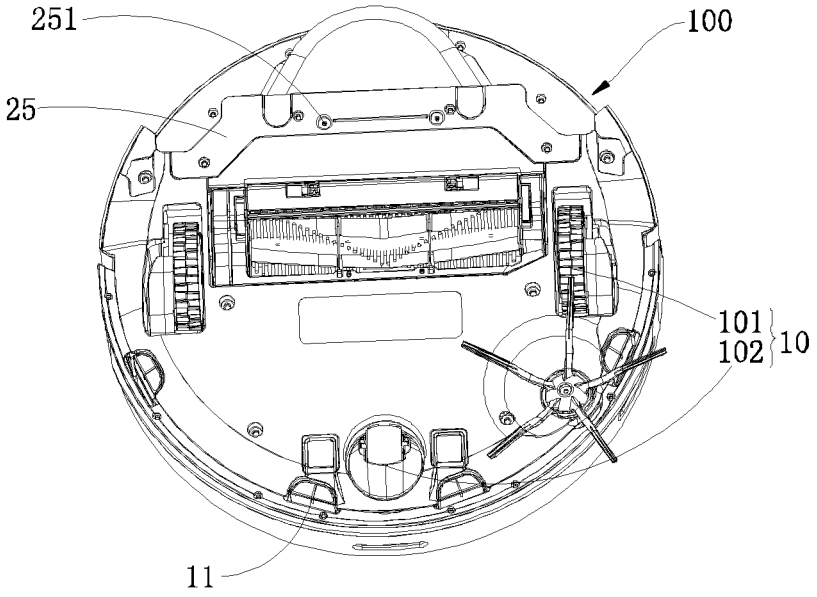
FIG. 5 is an axonometric view of a machine body according to some embodiments of the present disclosure.
Figure 6:
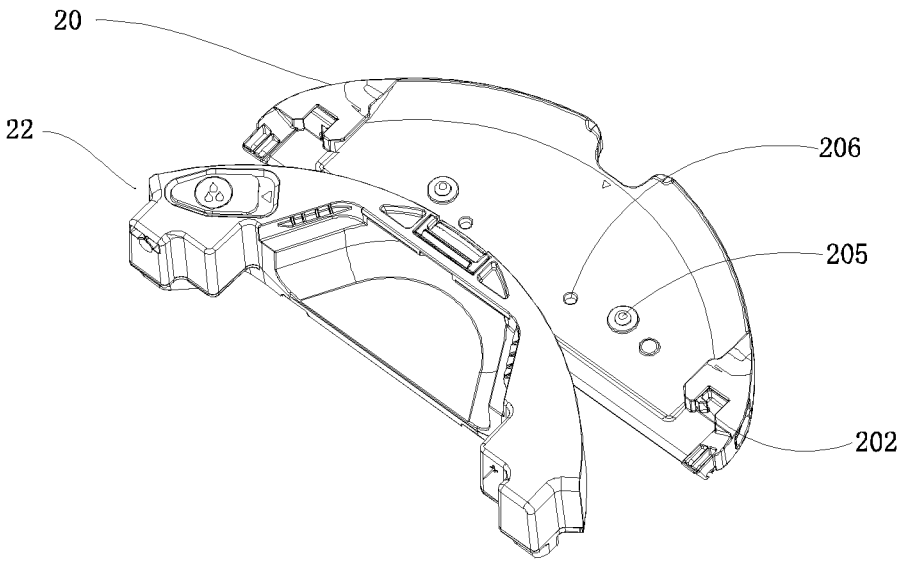
FIG. 6 is an exploded view of a connecting structure between a supporting plate and a water tank according to some embodiments of the present disclosure.
Figure 7:
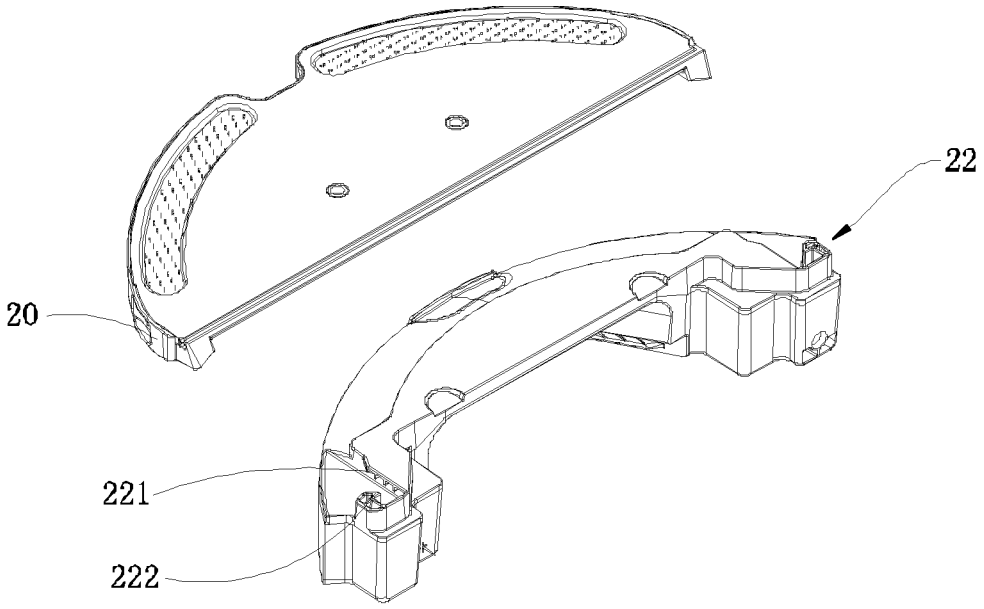
FIG. 7 is an exploded view of a connecting structure between a supporting plate and a water tank from another perspective according to some embodiments of the present disclosure.
Figure 8:
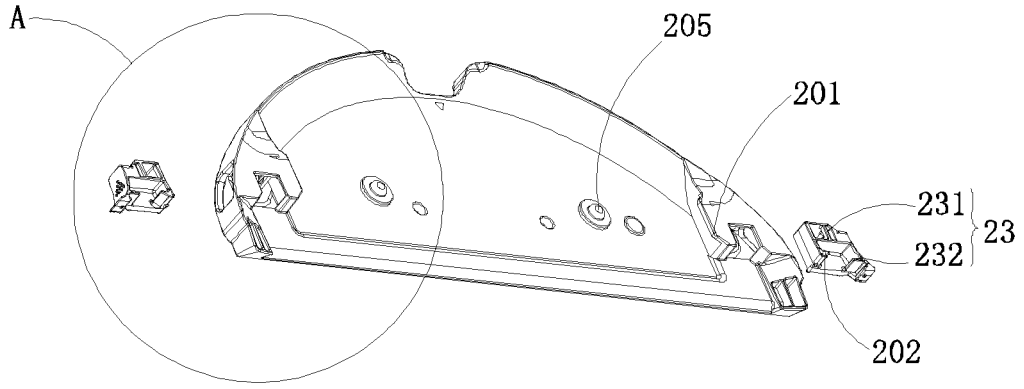
FIG. 8 is an exploded view of a connecting structure between a supporting plate and a control structure arranged on the supporting plate according to some embodiments of the present disclosure.
Figure 9:
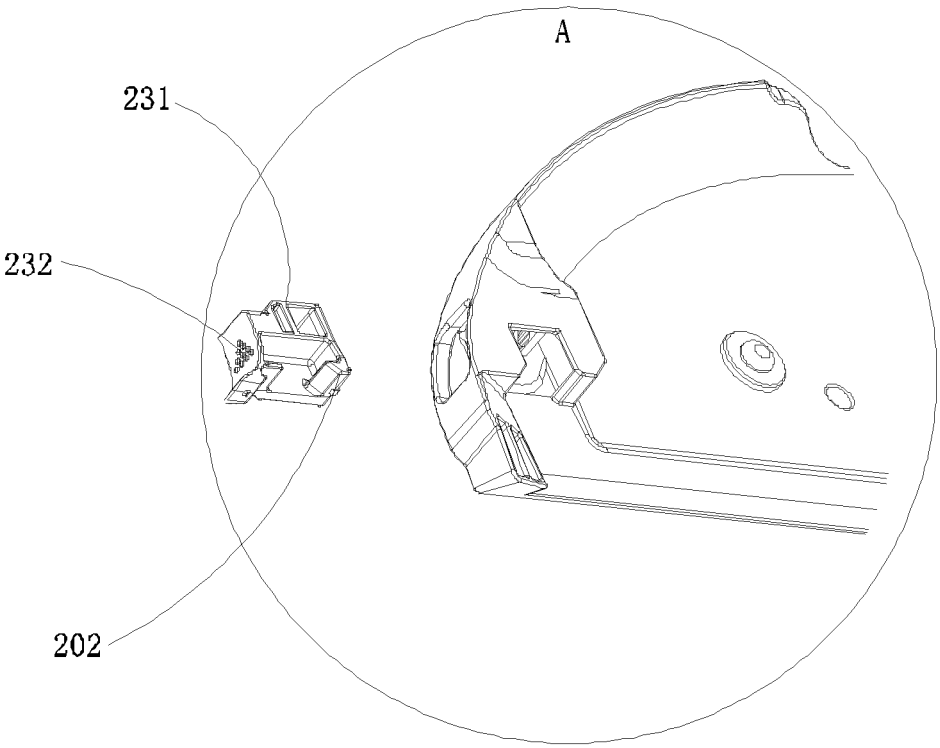
FIG. 9 is an enlarged view of a partial structure at position A in FIG. 8.
Figure 10:
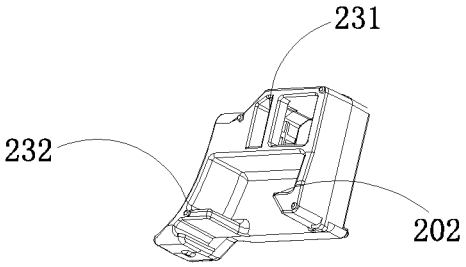
FIG. 10 is a schematic structural diagram of an integrated structure of a second hook and a control structure according to some embodiments of the present disclosure.
Figure 11:
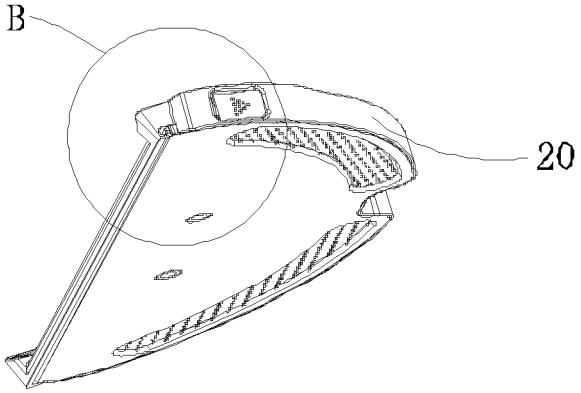
FIG. 11 is a schematic structural diagram of a connecting structure between a supporting plate and a control structure arranged on the supporting plate according to some embodiments of the present disclosure.
Figure 12:
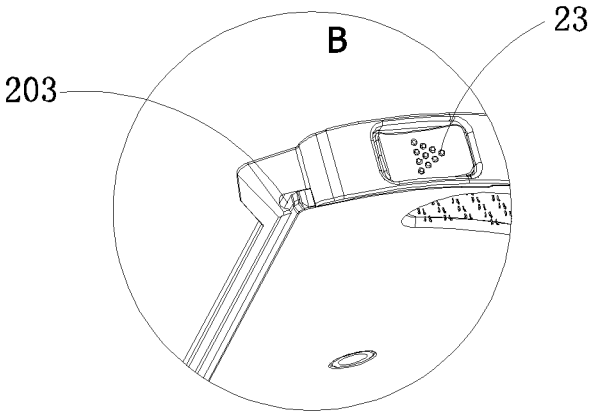
FIG. 12 is an enlarged view of a partial structure at position B in FIG. 11.

References are made to FIG. 1 to FIG. 12. FIG. 1 is an exploded view of a smart cleaning device according to some embodiments of the present disclosure. FIG. 2 is an exploded view of a smart cleaning device from another perspective according to some embodiments of the present disclosure. FIG. 3 is an axonometric view of a smart cleaning device according to some embodiments of the present disclosure. FIG. 4 is an axonometric view of a smart cleaning device from another perspective according to some embodiments of the present disclosure. FIG. 5 is an axonometric view of a machine body 100 according to some embodiments of the present disclosure. FIG. 6 is an exploded view of a connecting structure between a supporting plate 20 and a water tank 22 according to some embodiments of the present disclosure. FIG. 7 is an exploded view of a connecting structure between a supporting plate 20 and a water tank 22 from another perspective according to some embodiments of the present disclosure. FIG. 8 is an exploded view of a connecting structure between a supporting plate 20 and a control structure 23 arranged on the supporting plate 20 according to some embodiments of the present disclosure. FIG. 9 is an enlarged view of a partial structure at position A in FIG. 8. FIG. 10 is a schematic structural diagram of an integrated structure of a second hook 202 and a control structure 23 according to some embodiments of the present disclosure. FIG. 11 is a schematic structural diagram of a connecting structure between a supporting plate 20 and a control structure 23 arranged on the supporting plate 20 according to some embodiments of the present disclosure. FIG. 12 is an enlarged view of a partial structure at position B in FIG. 11.

Definitions of Names

Forward: a traveling direction of the smart cleaning device.

Backward: a direction opposite to the traveling direction of the smart cleaning device.

Referring to FIG. 1 to FIG. 7, a smart cleaning device provided in embodiments of the present disclosure includes a machine body 100 and a cleaning assembly 200. The machine body 100 is configured to carry functional parts of the smart cleaning device. The cleaning assembly 200 is detachably arranged on the machine body 100. When the cleaning assembly 200 is mounted to or removed from the machine body 100, the cleaning assembly 200 can move in a forward or backward direction of the machine body 100. In some optional embodiments, the cleaning assembly 200 includes a liquid holding tank, a connecting plate, and a flexible cleaning body that are stacked. The connecting plate is mounted at the bottom of the liquid holding tank by using a guide structure. After the connecting plate is mounted at the bottom of the liquid holding tank, the connecting plate can float up and down relative to the liquid holding tank. In some optional embodiments, the smart cleaning device is a smart sweeping robot 1, the connecting plate is a supporting plate 20, the flexible cleaning body is a cleaning cloth 21, and the liquid holding tank is a water tank 22.

According to the smart cleaning device provided in the embodiments of the present disclosure, in some optional embodiments, the guide structure includes a guide protrusion 201 and a guide groove 221 that cooperate with each other. The guide protrusion 201 is arranged on the supporting plate 20, and the guide groove 221 is arranged on the water tank 22. A thickness of the guide protrusion 201 is smaller than a thickness of the guide groove 221, so that after the supporting plate 20 is mounted at the bottom of the water tank 22, the supporting plate 20 can float up and down relative to the water tank 22. Optionally, the thickness of the guide protrusion 201 is a thickness of the guide protrusion 201 in a height direction of the smart sweeping robot 1, and the thickness of the guide groove 221 is a thickness of the guide groove 221 in the height direction of the smart sweeping robot 1.

It can be understood that the guide structure is not limited to the foregoing structural form, and a specific structure of the guide structure can also be arranged as follows: the guide structure includes the guide protrusion 201 and the guide groove 221 that cooperate with each other. The guide protrusion 201 is arranged on the water tank 22, and the guide groove 221 is arranged on the supporting plate 20. The thickness of the guide protrusion 201 is smaller than the thickness of the guide groove 221, so that after the supporting plate 20 is mounted at the bottom of the water tank 22, the supporting plate 20 can float up and down relative to the water tank 22. The thickness of the guide protrusion 201 is the thickness of the guide protrusion 201 in the height direction of the smart sweeping robot 1, and the thickness of the guide groove 221 may alternatively be the thickness of the guide groove 221 in the height direction of the smart sweeping robot 1. The structural design of the guide structure only needs to meet the mounting requirements of the water tank 22 and the supporting plate 20, and ensure that the supporting plate 20 can move in the forward or backward direction of the smart sweeping robot 1. Optionally, the design of the guide structure further needs to ensure that after the supporting plate 20 is mounted on the water tank 22, the supporting plate 20 can float up and down relative to the water tank 22.

According to the smart cleaning device provided in the embodiments of the present disclosure, the entire cleaning assembly 200 can be removed from the machine body 100 of the smart sweeping robot 1 in the forward or backward direction of the smart sweeping robot 1, and the supporting plate 20 can also be separately removed from the body of the smart sweeping robot 1 in the forward or backward direction of the smart sweeping robot 1. This is convenient for operation.

Further referring to FIG. 6 and FIG. 7, according to the smart cleaning device provided in the embodiments of the present disclosure, further, after being mounted on the water tank 22, the supporting plate 20 is connected to the water tank 22 by using a connecting structure. The connecting structure includes a first connecting structure arranged on the water tank 22 and a second connecting structure arranged on the supporting plate 20, where the first connecting structure and the second connecting structure cooperate with each other. In some optional embodiments, the first connecting structure is a first hook 222 arranged on the water tank 22, and the second connecting structure is a second hook 202 arranged on the supporting plate 20. After the supporting plate 20 is mounted at the bottom of the water tank 22 by using the guide structure, the first hook 222 and the second hook 202 can be engaged with each other, so that the supporting plate 20 and the water tank 22 are firmly connected.

Further referring to FIG. 8 and FIG. 12, optionally, the connecting structure further includes a control structure 23. The control structure 23 is arranged on the supporting plate 20, and can control the connection and separation of the first hook 222 and the second hook 202. In some optional embodiments, the control structure 23 and the second hook 202 are an integrated structure. The control structure 23 includes: a mounting bracket 231, where the mounting bracket 231 is movably arranged on the supporting plate 20, and the second hook 202 is connected to one end of the mounting bracket 231 so that the second hook 202 can move to a stopper position or a bypass position under the driving of the mounting bracket 231; and an operating part 232, where the operating part 232 is arranged at the other end of the mounting bracket 231, and is arranged opposite to the second hook 202, so as to control the movement of the mounting bracket 231 by using the operating part 232. The specific operation process is as follows: when the operating part 232 is pressed toward the inside of the main body of the smart sweeping robot 1, the entire control structure 23 moves toward the inside of the main body of the smart sweeping robot 1. In this case, the second hook 202 is driven by the control structure 23 to move toward the inside of the main body of the smart sweeping robot 1 until reaching the bypass position, so that the first hook 222 and the second hook 202 are separated. After the first hook 222 and the second hook 202 are separated, the supporting plate 20 can be further removed from the water tank 22 along the guide structure. This is convenient for operation. After the cleaning cloth 21 is replaced, and the supporting plate 20 is mounted to the bottom of the water tank 22 again, the second hook 202 is located at the stopper position under the restriction of the guide protrusion 201, so that the first hook 222 and the second hook 202 are connected to each other, and further, the water tank 22 and the supporting plate 20 are firmly connected.

In some optional embodiments, the guide protrusion 201 is arranged on the supporting plate 20, and the guide protrusion 201 is an elastic structure. When the second hook 202 moves to the bypass position, the guide protrusion 201 can be elastically deformed under the pressure of the second hook 202, so that the first hook 222 and the second hook 202 are separated. When the second hook 202 moves to the stopper position, the guide protrusion 201 can be restored to the original state, so that the first hook 222 and the second hook 202 are connected to each other.

It can be understood that the control structure 23 may be but is not limited to the foregoing structural form. The control structure 23 can alternatively be arranged on the water tank 22. In addition, optionally, the control structure 23 and the first hook 222 can be an integrated structure, which can control the connection and separation of the first hook 222 and the second hook 202.

References are made to FIG. 1, FIG. 2, and FIG. 12. According to the smart cleaning device provided in the embodiments of the present disclosure, the supporting plate 20 and the cleaning cloth 21 are detachably connected using a sliding assembly. The sliding assembly includes a mounting groove 203 and a guide bar 211 that cooperate with each other. In some optional embodiments, the mounting groove 203 is arranged on the supporting plate 20, the guide bar 211 is arranged on the cleaning cloth 21, the guide bar 211 can penetrate into the mounting groove 203 to connect the cleaning cloth 21 and the supporting plate 20, and the guide bar 211 can stretch out of the mounting groove 203 to separate the cleaning cloth 21 from the supporting plate 20, so that when the cleaning cloth 21 needs to be removed, the cleaning cloth 21 can be directly removed from the supporting plate 20 for replacement or cleaning. This is convenient for operation. In addition, this can avoid the situation that when the cleaning cloth 21 is to be replaced for the existing smart sweeping robot 1, the smart sweeping robot 1 needs to be turned over and then the cleaning cloth 21 is removed together with the water tank 22 or the supporting plate 20, easily causing collision and damage to the smart sweeping robot 1, further damaging a sensor on the smart sweeping robot 1, or even causing irreparable damage to a circuit and a component inside the smart sweeping robot 1, which further results in greater economic loss. The supporting plate 20 and the water tank 22 are detachably connected. When the supporting plate 20 is mounted to or removed from the machine body 100, the supporting plate 20 moves in a forward or backward direction of the machine body 100, so that the cleaning cloth 21 together with the supporting plate 20 is removed from the water tank 22 of the smart sweeping robot 1. When the supporting plate 20 of the cleaning assembly 200 is assembled to or removed from the water tank 22, the supporting plate 20 moves in a forward or backward direction of the water tank 22, and generally the forward and backward directions of the water tank 22 are horizontal directions, which makes the mounting and removal of the supporting plate 20 with the cleaning cloth 21 more convenient, and further avoid the situation that the cleaning assembly 200 can be removed only when the smart sweeping robot 1 is turned over to the bottom side up. This further facilitates the replacement and maintenance of the cleaning assembly 200. It can be understood that the smart cleaning device may be but is not limited to the smart sweeping robot 1. In some other optional embodiments, the smart cleaning device may alternatively be a solar panel cleaning apparatus, a building exterior wall cleaning apparatus, etc.

It can be understood that the cleaning assembly 200 may be but is not limited to the foregoing structural form. In some other optional embodiments, the mounting groove 203 may alternatively be arranged on the cleaning cloth 21, and the guide bar 211 may alternatively be arranged on the supporting plate 20, provided that the mounting and removal of the supporting plate 20 and the cleaning cloth 21 can be conveniently implemented.

For example, in the embodiments shown in FIG. 1 and FIG. 12, the mounting groove 203 is arranged at an end portion of one side of the supporting plate 20 away from the machine body 100, and the guide bar 211 is arranged at a position on the cleaning cloth 21 corresponding to the mounting groove 203, that is, an end portion of the cleaning cloth 21. However, it can be understood that in some other optional embodiments, the mounting groove 203 may alternatively be arranged at a middle position of one side of the supporting plate 20 away from the machine body 100. Correspondingly, a position of the guide bar 211 on the cleaning cloth 21 corresponds to the mounting groove 203, that is, the guide bar 211 is arranged at a middle position of the cleaning cloth 21.

According to the smart cleaning device provided in the embodiments of the present disclosure, one end of the mounting groove 203 on the supporting plate 20 is a mounting end, and the other end of the mounting groove 203 is a stopper end. The guide bar 211 can penetrate into or stretch out of the mounting groove 203 by using the mounting end, and the stopper end restricts the guide bar 211 to stretch out of the mounting groove 203 from the stopper end.

In some optional embodiments, the guide bar 211 may be a plastic rod or a steel rod with specific rigidity, or may be a flexible strip. A cross-sectional shape of the guide bar 211 may be circular or another non-circular shape. A cross-sectional shape of the mounting groove 203 on the supporting plate 20 is a C-shape or a C-like shape, provided that the guide bar 211 can be accommodated and restricted. An opening of the mounting groove 203 for the cleaning cloth 21 to stretch faces downward, that is, the C-shaped opening faces downward. One end of the mounting groove 203 is a stretching-in end, and the stretching-in end does not have a stopper structure and is available for the guide bar 211 to stretch in. The other end of the mounting groove 203 is a stopper end, and the stopper end has a stopper structure to prevent the guide bar 211 from coming out of this end. In other words, one end of the mounting groove 203 is closed, and the other end of the mounting groove 203 is open. A tail of the cleaning cloth 21 is fixed on the supporting plate 20 through cooperation between the guide bar 211 and the mounting groove 203, thereby improving stability of the fixing and preventing the cleaning cloth 21 from falling off. The guide bar 211 and the mounting groove 203 are located on the supporting plate 20, facing the forward direction of the smart sweeping robot 1. The manner of first mounting the guide bar 211 and then sticking the cleaning cloth 21 on a Velcro ensures that the cleaning cloth 21 is mounted correctly.

Further referring to FIG. 1 and FIG. 2, the cleaning cloth 21 may be a cleaning cloth 21 made of the same material as a whole, or a composite cleaning cloth 21 made of different materials at different positions. In some optional embodiments, the cleaning cloth 21 is a composite cleaning cloth 21, and a main body of the cleaning cloth 21 is basically semicircular. An inner layer of the cleaning cloth 21 is a water seepage area, which is made of a material with a high water seepage rate. A middle layer of the cleaning cloth 21 is a dirt-removing area, which is made of a hard material and is used to scrape off hard matters on the floor. An outer layer of the cleaning cloth 21 is a water absorption area, which is made of a material with a good water absorption effect, and is used to absorb water on the floor and remove water stains and water marks. This can improve cleaning efficiency. The guide bar 211 is arranged on a straight line segment of a semicircle.

Further referring to FIG. 5 and FIG. 6, according to the smart cleaning device provided in the embodiments of the present disclosure, the supporting plate 20 is provided with a water passage hole 206 for connecting water in the water tank 22 to the cleaning cloth 21. In some optional embodiments, the water tank 22 may be an electronically controlled water tank 22 provided with a peristaltic pump, and a waterway board is arranged inside the smart sweeping robot 1. Optionally, the waterway board is a reversed return waterway board 25. The reversed return waterway board 25 is arranged between the machine body 100 and the supporting plate 20, and is detachably connected to the machine body 100. In addition, the reversed return waterway board 25 is provided with a water inlet port and a water outlet port 251, the water inlet port is connected to a water outlet pipeline of the peristaltic pump inside the water tank 22, and a position of the water outlet port 251 is arranged corresponding to the water passage hole 206 on the supporting plate 20, so that the water in the water tank 22 flows onto the cleaning cloth 21 through the water outlet port 251 of the reversed return waterway board 25 and the water passage hole 206 on the supporting plate 20.

Further referring to FIG. 1 and FIG. 2, according to the smart cleaning device provided in the embodiments of the present disclosure, the water tank 22 is arranged corresponding to the shape of the joint position of the machine body 100. After the water tank 22 is mounted on the machine body 100, an outer side wall of the water tank 22 is connected to the side wall of the machine body 100, a bottom wall of the water tank 22 is connected to a bottom wall of the machine body 100, and the water tank 22 at least partially surrounds an outer side of a fan inside the machine body 100. As shown in FIG. 2, the fan is arranged inside a fan mounting position 16. In some optional embodiments, the water tank 22 can be connected to or separated from the machine body 100 by using a button 24, and the supporting plate 20 is provided with a notch 204 for bypassing the button 24. In an embodiment of the present disclosure, the notch 204 is a notch 204 that is arranged on the top of the supporting plate 20 and that matches an outline of the button 24. When the cleaning assembly 200 needs to be removed from the machine body 100, the cleaning assembly 200 can be detached from the machine body 100 by pressing and holding the button 24.

Further referring to FIG. 6, according to the smart cleaning device provided in the embodiments of the present disclosure, in some optional embodiments, an elastic part 205 is arranged on a side surface of the supporting plate 20 facing the water tank 22, and after the supporting plate 20 is mounted on the water tank 22, the supporting plate 20 is in elastic contact with the water tank 22, so that the water tank 22 can float up and down relatively smoothly. In addition, the elastic part 205 on the supporting plate 20 abuts against the bottom surface of the water tank 22, so that during operation of the supporting plate 20, a pressing force is generated between the supporting plate 20 and the floor, further attaching the cleaning cloth 21 to the floor more closely, and achieving a good cleaning effect. Optionally, the elastic part 205 includes a plurality of elastic buttons arranged at intervals on a side surface of the supporting plate 20 facing the water tank 22, and a spring is arranged inside each of the elastic buttons.

It can be understood that the elastic part 205 may be but is not limited to the foregoing structure. The elastic part 205 may alternatively be arranged on a side surface of the water tank 22 facing the supporting plate 20. The elastic part 205 includes a plurality of elastic buttons arranged at intervals on a side surface of the water tank 22 facing the supporting plate 20. Certainly, the elastic part 205 can be arranged on both the side surface of the water tank 22 facing the supporting plate 20 and the side surface of the supporting plate 20 facing the water tank 22. After the supporting plate 20 is mounted on the water tank 22, the supporting plate 20 is in elastic contact with the water tank 22. In an embodiment of the present disclosure, when the elastic part 205 is arranged on both the side surface of the water tank 22 facing the supporting plate 20 and the side surface of the supporting plate 20 facing the water tank 22, the elastic part 205 arranged on the side surface of the water tank 22 facing the supporting plate 20 and the elastic part 205 arranged on the side surface of the supporting plate 20 facing the water tank 22 are staggered, so as to further achieve a good elastic contact effect between the water tank 22 and the supporting plate 20.

Further referring to FIG. 1 and FIG. 2, according to the smart cleaning device provided in the embodiments of the present disclosure, in some optional embodiments, the machine body 100 includes a perception system (not shown in the figures), a control system (not shown in the figures), a driving system 10, an energy system, a man-machine interaction system, a dry cleaning portion 13, etc. The following describes the main parts of the smart cleaning device.

In some optional embodiments, the machine body 100 further includes an upper cover, a forward portion, a backward portion, a chassis, etc. The machine body 100 has an approximate circular shape or may have other shapes, including but not limited to the approximate D-shape, that is, the front is straight and the back is circular.

The perception system includes sensing apparatuses such as a position determining apparatus located in an upper part of the machine body 100, a buffer located in the forward portion of the machine body 100, a cliff sensor, an ultrasonic sensor, an infrared sensor, a magnetometer, an accelerometer, a gyroscope, and an odometer. These sensing apparatuses provide various position information and motion state information of the machine for the control system. The position determining apparatus includes but is not limited to an infrared emitting and receiving apparatus, a camera, and a laser distance sensor (LDS).

The driving system 10 is configured to drive the machine body 100 and the parts thereon to move, so as to implement automatic walking and sweeping. The driving system 10 includes a driving wheel module 101. The driving system 10 can send a driving command to control the smart sweeping robot 1 to move across the floor, based on distance and angle information such as x, y, and 0 components. The driving wheel module 101 can control a left wheel and a right wheel simultaneously. To control the movement of the machine more accurately, the driving wheel module 101 includes a left driving wheel module and a right driving wheel module. The left and right driving wheel modules are symmetrically arranged along a lateral axis that is defined by the machine body 100. Optionally, the left and right driving wheel modules are symmetrically arranged. To enable the smart sweeping robot 1 to move more stably on the floor or to have a higher movement ability, the smart sweeping robot 1 may include one or more driven wheels 102, and the driven wheels include but are not limited to universal wheels.

The driving wheel module 101 includes a traveling wheel, a driving motor, and a control circuit for controlling the driving motor. The driving wheel module 101 can alternatively be connected to a circuit for measuring a drive current, and to an odometer. The driving wheel module 101 can be detachably connected to the machine body 100 for easy assembly, disassembly, and maintenance. The driving wheel may have a biased-to-drop hanging system, which is secured in a movable manner, for example, is attached to the machine body 100 in a rotatable manner, and receives a spring bias that is offset downward and away from the machine body 100. The spring bias allows the driving wheel to maintain contact and traction with the floor by using a specific touchdown force, and the cleaning element (such as the rolling brush 131) of the smart sweeping robot 1 is also in contact with the floor with a specific pressure.

The forward portion 14 of the machine body 100 may carry a buffer. When the driving wheel module 101 drives the smart sweeping robot 1 to walk on the floor during cleaning, the buffer detects one or more events in the traveling route of the smart sweeping robot 1 by using a sensor system, such as an infrared sensor. Based on the events detected by the buffer, such as obstacles and walls, the smart sweeping robot 1 can control the driving wheel module 101 to enable the smart sweeping robot 1 to respond to the events, for example, keep away from the obstacles.

The control system is set on the main circuit board in the machine body 100. The control system includes non-transient memories such as a hard disk, a flash memory, and a random access memory, and computing processors for communication, such as a central processing unit and an application processor. The application processor draws, based on obstacle information fed back by a laser distance sensor and by using a positioning algorithm such as SLAM, an instant map of an environment in which the smart sweeping robot 1 is located. With reference to distance information and velocity information fed back by sensing apparatuses such as the buffer, the cliff sensor 11, the ultrasonic sensor, the infrared sensor, the magnetometer, the accelerometer, the gyroscope, and the odometer, the control system comprehensively determines a current working status of the sweeping machine, such as crossing a threshold, walking on a carpet, reaching a cliff, being stuck by the upper part or lower part, full dust box, or being picked up. In addition, the control system provides a specific next action strategy based on different situations, so that the smart sweeping robot 1 well meets the user's requirements, providing good user experience. Furthermore, the control system can plan a most efficient and reasonable sweeping route and sweeping manner based on information about the instant map that is drawn based on SLAM, thereby greatly improving the sweeping efficiency of the smart sweeping robot 1.

The energy system includes a rechargeable battery, for example, a NiMH battery or a lithium battery. The rechargeable battery can be connected to a charging control circuit, a battery pack charging temperature detection circuit, and a battery undervoltage monitoring circuit. The charging control circuit, the battery pack charging temperature detection circuit, and the battery undervoltage monitoring circuit are connected to a single-chip microcomputer control circuit. The robot is charged by connecting a charging electrode arranged on a side or a lower part of the machine body to the charging pile. If there is dust on the exposed charging electrode, the plastic part around the electrode is melted and deformed due to a charge accumulation effect, or even the electrode is deformed and cannot perform charging normally.

The man-machine interaction system 12 includes buttons on a panel of the robot, which are used by the user to select functions; may further include a display screen, an indicator, and/or a horn, which display the current status of the machine or function options for the user; and may further include a mobile phone client program. For a route-navigated cleaning device, the mobile phone client can show the user a map of the environment in which the device is located, as well as the location of the machine, providing the user with more abundant and user-friendly function options.

References are further made to FIG. 3. To describe behavior of the smart sweeping robot 1 more clearly, the following describes definitions of directions. The smart sweeping robot 1 can travel on the floor based on various combinations of movements relative to the following three mutually perpendicular axes defined by the machine body 100: the front-back axis X (that is, the axis along the direction of the forward portion 14 and the backward portion 15 of the machine body 100), the lateral axis Y (that is, the axis perpendicular to the axis X and located on the same horizontal plane as the axis X), and the central vertical axis Z (the axis perpendicular to the plane formed by the axis X and the axis Y). The forward driving direction along the front-back axis X is marked as "forward", and the backward driving direction along the front-back axis X is marked as "backward". The lateral axis Y essentially extends between the right and left wheels of the smart sweeping robot 1 along an axial center defined by the center point of the driving wheel module 101.

The smart sweeping robot 1 can rotate around the axis Y. When the forward portion of the smart sweeping robot 1 is tilted upward and the backward portion is tilted downward, "pitchup" is formed. When the forward portion of the smart sweeping robot 1 is tilted downward and the backward portion is tilted upward, "pitchdown" is formed. In addition, the smart sweeping robot 1 can rotate around the axis Z. In the forward direction of the smart sweeping robot 1, when the smart sweeping robot 1 tilts to the right of the axis X, "right turn" is formed; and when the smart sweeping robot 1 tilts to the left of the axis X, "left turn" is formed.

The dust box is mounted in a receiving cavity through clamping of a manipulator. When the manipulator is clamped, a clamping part is contracted. When the manipulator is released, the clamping part stretches out and is clamped in a recess for holding the clamping part in the receiving cavity.

The cleaning assembly 200 serves as a wet cleaning portion of the smart sweeping robot 1, and its main function is to wipe a to-be-cleaned surface (such as a floor) by using a cleaning cloth 21 that contains cleaning liquid. A main function of the dry cleaning portion 13 is to remove specific particulate pollutants from the to-be-cleaned surface by using a structure such as a sweeping brush. The main cleaning function of the dry cleaning portion 13 is derived from the second cleaning portion that includes a rolling brush 131, a dust box, a fan, an air outlet, and connecting parts between the four parts. The rolling brush 131 that has specific interference with the floor sweeps rubbish on the floor and rolls the rubbish to the front of a dust suction port between the rolling brush 131 and the dust box, and then the rubbish is sucked into the dust box by gas that is generated by the fan and that has suction force and passes through the dust box. A dust removal ability of the smart sweeping robot 1 can be represented by dust pick up efficiency (DPU). The DPU is affected by a structure and material of the rolling brush 131, by wind power utilization of an air duct made up of the dust suction port, the dust box, the fan, the air outlet, and the connecting parts between the four parts, and by a type and power of the fan. The increase in the dust removal ability is more significant for energy-limited smart sweeping robots 1 than for conventional plug-in cleaners. The increase in the dust removal ability directly and effectively reduces the energy requirement, that is, a smart sweeping robot 1 that can clean 80 square meters of the floor previously after being charged for one time can be evolved to clean 100 or more square meters of the floor after being charged for one time. In addition, as a quantity of charging times decreases, a service life of a battery increases greatly, so that frequency of replacing the battery by the user decreases. More intuitively and importantly, a higher dust removal ability is the most visible and important user experience, because it allows the user to directly determine whether the floor is swept/wiped clean. The dry cleaning assembly 200 may further include a side brush 132 having a rotating shaft. The rotating shaft is located at an angle relative to the floor, so as to move debris into a sweeping region of the rolling brush 131 of the second cleaning portion.

Embodiments of the present disclosure further provide a blockage 300. The blockage 300 has a good blocking effect on a water tank 22 of the smart cleaning device, and therefore can avoid water leakage in the water tank 22. In addition, the blockage 300 is conveniently mounted.

To better understand the technical solutions provided in the present disclosure, the following describes in detail the blockage 300 according to the embodiments of the present disclosure with reference to FIG. 13 to FIG. 18.

Figure 13:
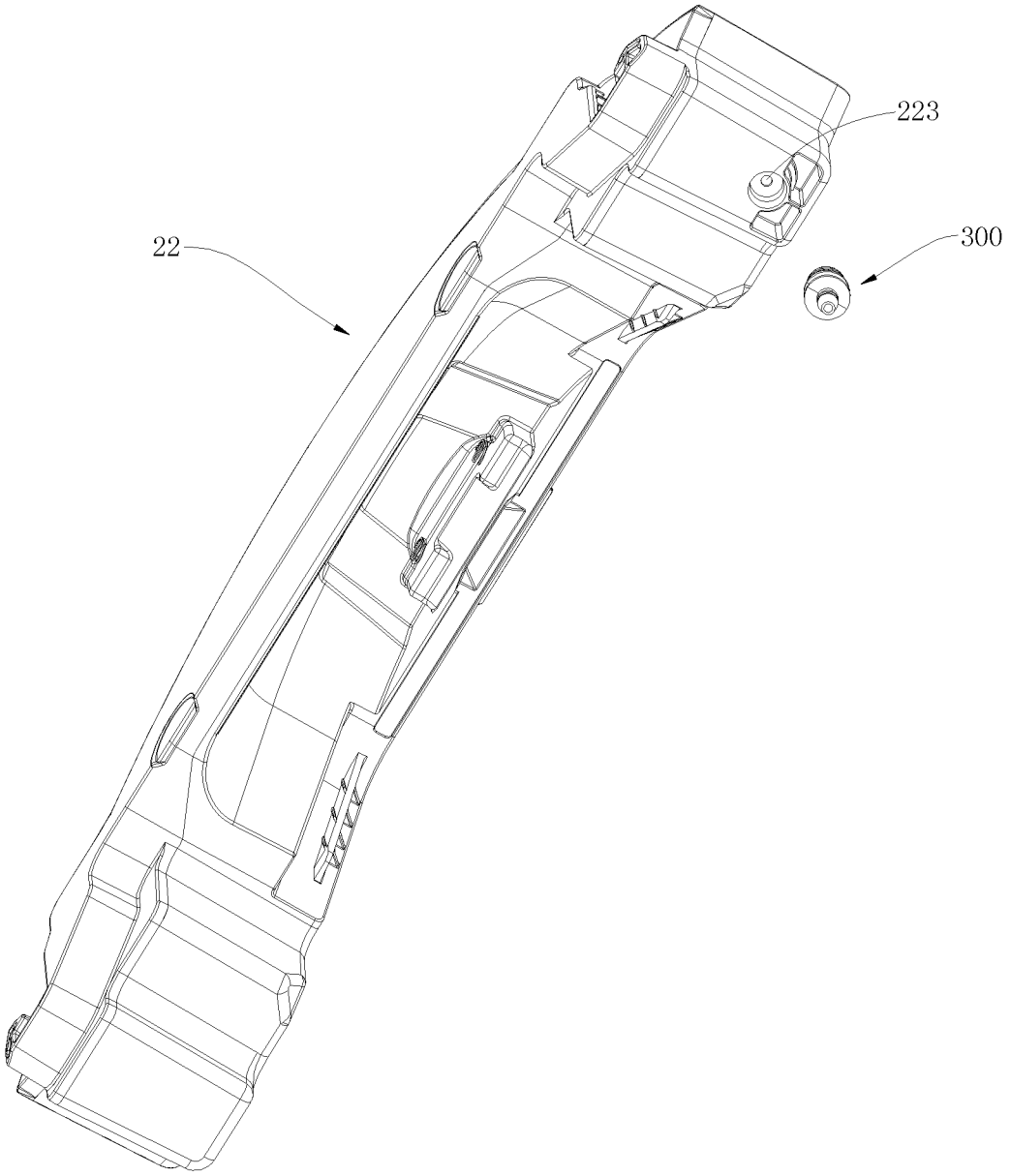
FIG. 13 is an exploded view of a connecting structure between a water tank and a blockage according to some embodiments of the present disclosure.
Figure 14:
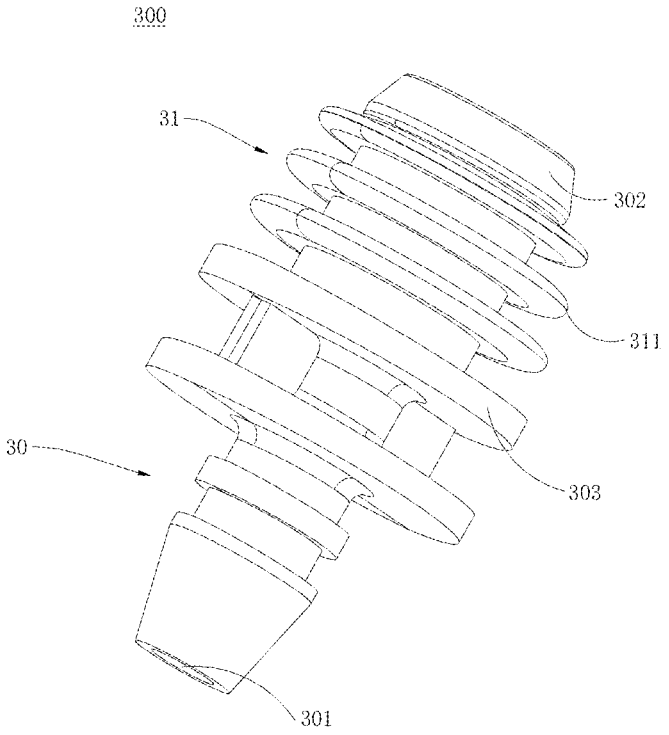
FIG. 14 and FIG. 14*a* are axonometric views of a blockage according to some embodiments of the present disclosure.
Figure 15:
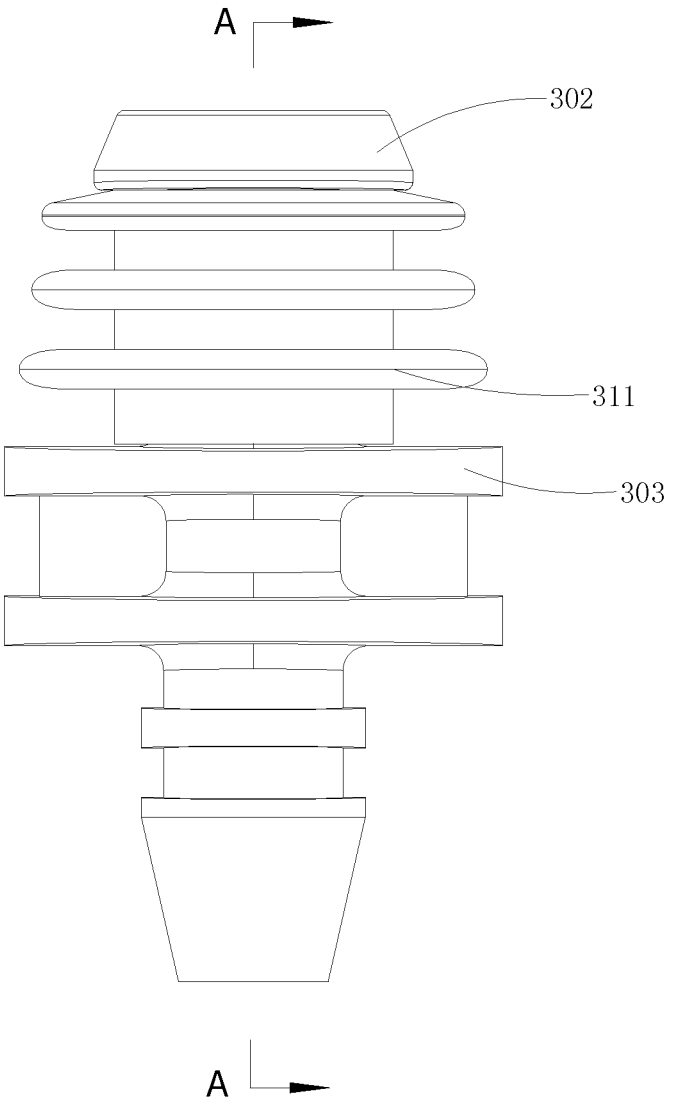
FIG. 15 is a schematic diagram of a planar structure of a blockage according to some embodiments of the present disclosure.
Figure 16:
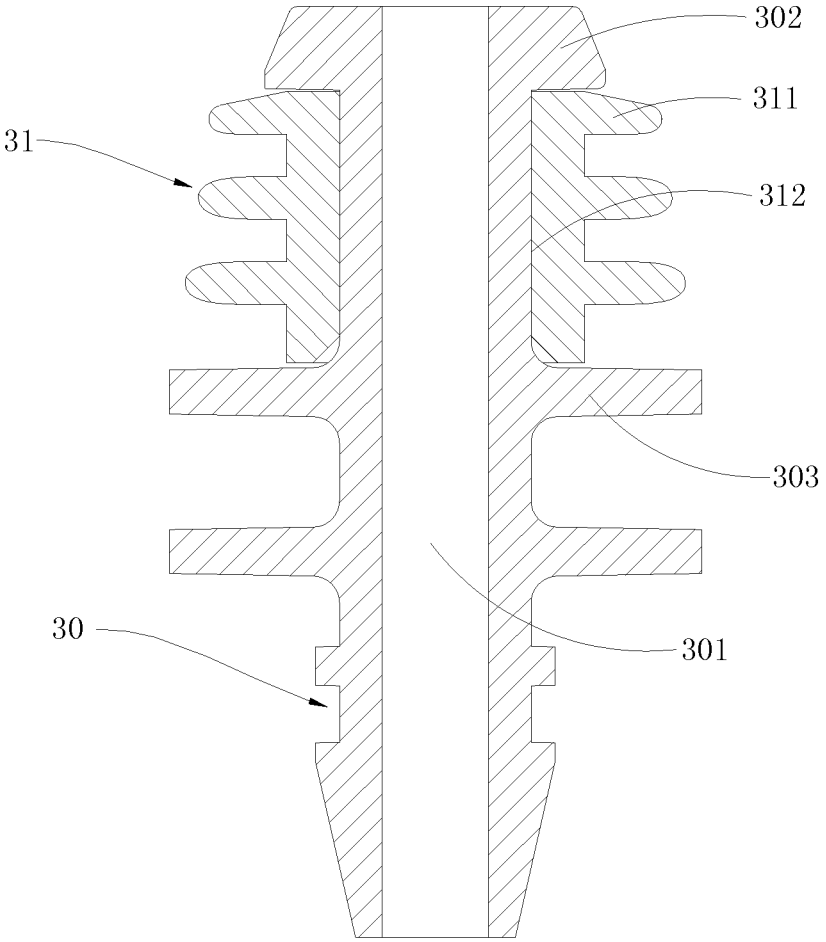
FIG. 16 is a sectional view in a direction A-A of FIG. 15.
Figure 17:
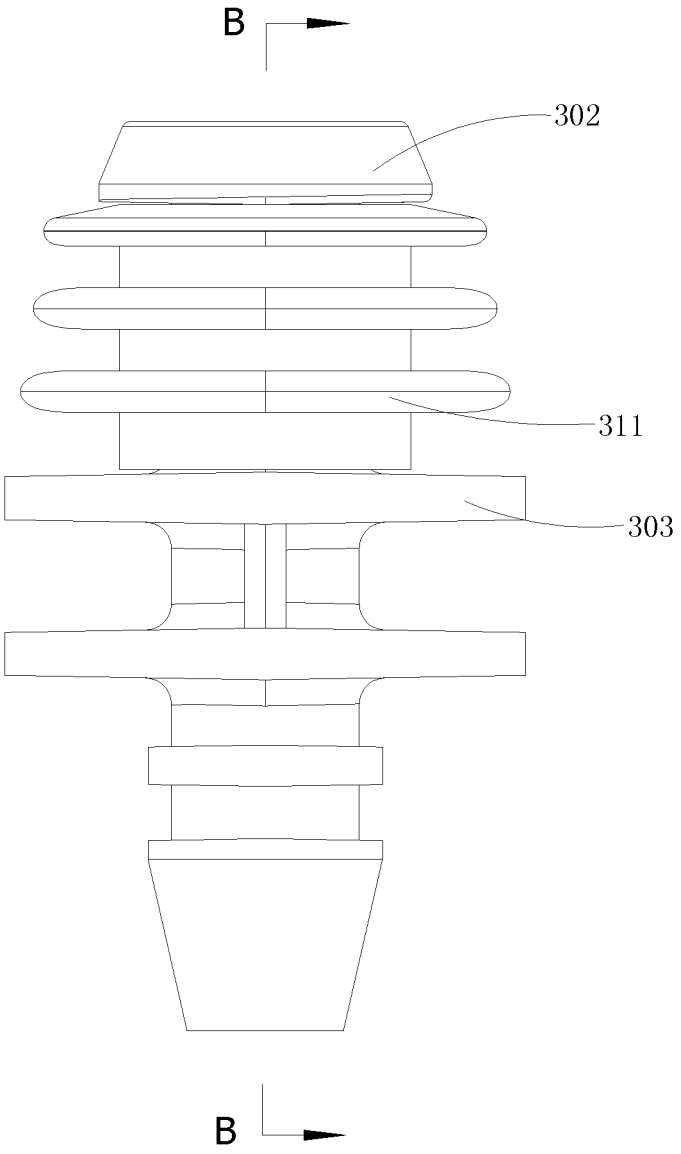
FIG. 17 is a schematic diagram of a planar structure of a blockage from another perspective according to some embodiments of the present disclosure.
Figure 18:
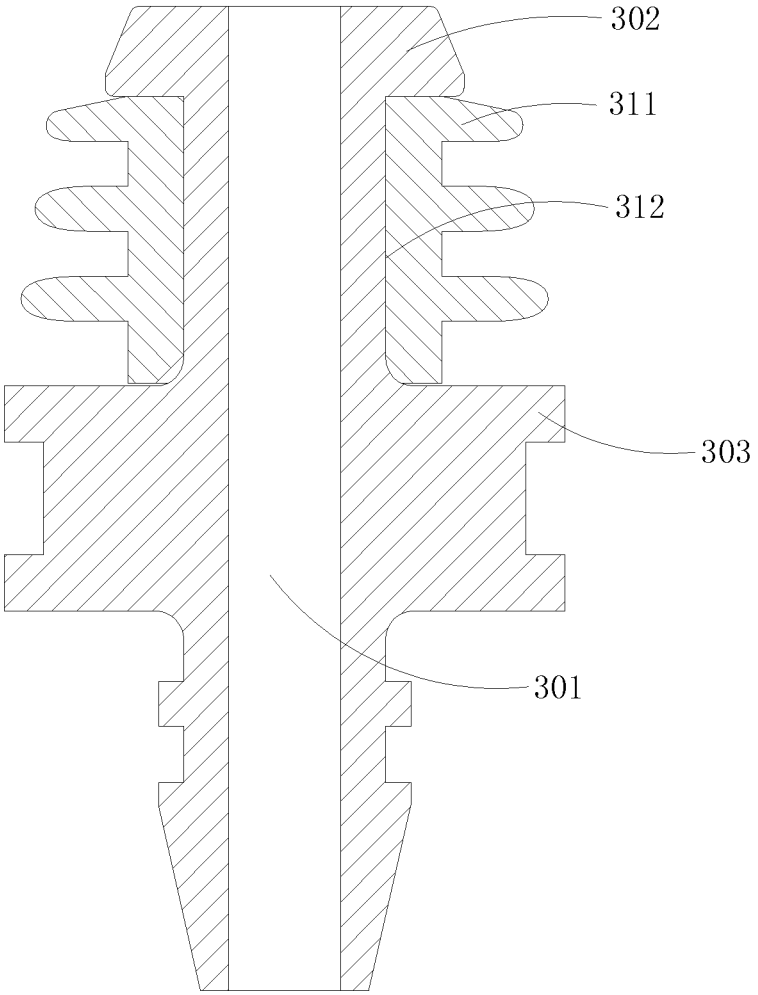
FIG. 18 is a sectional view in a direction B-B of FIG. 17.

FIG. 13 is an exploded view of a connecting structure between a water tank 22 and a blockage 300 according to some embodiments of the present disclosure. FIG. 14 is an axonometric view of a blockage 300 according to some embodiments of the present disclosure. FIG. 15 is a schematic diagram of a planar structure of a blockage 300 according to some embodiments of the present disclosure. FIG. 16 is a sectional view in a direction A-A of FIG. 15. FIG. 17 is a schematic diagram of a planar structure of a blockage 300 from another perspective according to some embodiments of the present disclosure. FIG. 18 is a sectional view in a direction B-B of FIG. 17.

Embodiments of the present disclosure further provide a blockage 300. The blockage 300 includes a plug body 30 and a hierarchical sealing structure 31. The plug body 30 is a shaft-shaped structure as a whole. The hierarchical sealing structure 31 is sleeved on an outer side of the plug body 30, and is provided with at least two annular plugs 311 stacked in an axial direction of the plug body 30. An outer diameter of an annular plug 311 of the two adjacent annular plugs 311 near an end of the plug body 30 is smaller than an outer diameter of an annular plug 311 of the two adjacent annular plugs 311 away from the end of the plug body 30. In the axial direction of the plug body 30, a thickness of an annular plug 311 of the two adjacent annular plugs 311 near an end of the plug body 30 is smaller than a thickness of an annular plug 311 of the two adjacent annular plugs 311 away from the end of the plug body 30. The foregoing structural design of hierarchical taper sealing gradually from the end of the blockage 300 toward the middle position can provide a lighter feel when the water tank 22 is mounted, and at the same time provide a good blocking effect.

Embodiments of the present disclosure further provide a blockage 300. Optionally, there are three annular plugs 311. In the axial direction of the plug body 30 and in the direction from the end of the plug body 30 toward the inside of the plug body 30, the outer diameters of the annular plugs 311 gradually increase, and the thicknesses of the annular plugs 311 gradually increase, so as to form a hierarchical sealing structure 31 with a good sealing effect. Optionally, the hierarchical sealing structure 31 is an elastic body made of an elastic material. It can be understood that the hierarchical sealing structure 31 made of an elastic material further facilitates the mounting of the blockage 300 and the water tank 22 and improves a sealing effect.

Embodiments of the present disclosure further provide a blockage 300. Optionally, the blockage 300 is configured to block a water outlet 223 of the water tank 22 of the smart cleaning device. The plug body 30 is provided with a through hole 301 that penetrates the plug body 30, so that the water in the water tank 22 can flow out of the water tank 22 through the through hole 301, and is finally diverted to the cleaning cloth 21 to implement the cleaning function. Optionally, the through hole 301 is a through hole 301 that penetrates the plug body 30 in the axial direction of the plug body 30.

Figure 14A:
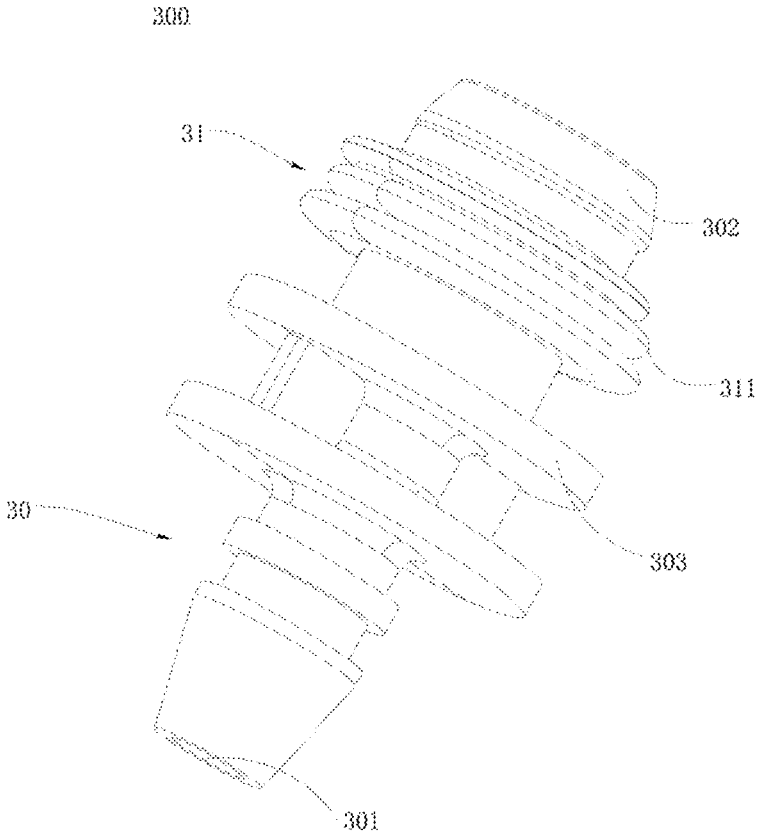

It can be understood that the three annular plugs 311 are arranged at intervals in the axial direction of the plug body 30, or may be arranged in close contact. When the three annular plugs 311 are arranged in close contact, the entire blockage 300 may be a circular truncated cone structure, as shown in FIG. 14*a*. In an embodiment of the present disclosure, when the three annular plugs 311 are arranged at intervals, a shape of a curved surface formed jointly by outer side walls of the three annular plugs 311 is the same as a shape of a side surface of the circular truncated cone.

Embodiments of the present disclosure further provide a blockage 300. Optionally, the three annular plugs 311 are arranged at intervals in the axial direction of the plug body 30, and the three annular plugs may alternatively be arranged as a structure in which a thickness of the annular plug 311 near the end of the plug body 30 is the largest, and thicknesses of the annular plugs 311 in the direction facing the inside of the plug body 30 gradually decrease.

Embodiments of the present disclosure further provide a blockage 300. A first retaining wall 302 and a second retaining wall 303 are respectively arranged at positions on the plug body 30 corresponding to two ends of the hierarchical sealing structure 31, to define relative positions of the hierarchical sealing structure 31 and the plug body 30 in the axial direction of the plug body 30. The two ends of the hierarchical sealing structure 31 in its own axial direction have two opposite end faces, and the two end faces are respectively arranged against the first retaining wall 302 and the second retaining wall 303, so as to sandwich the hierarchical sealing structure 31 between the first retaining wall 302 and the second retaining wall 303. That is, optionally, the hierarchical sealing structure 31 is relatively fixed to the plug body 30 in the axial direction of the plug body 30, and in some embodiments of the present disclosure, in a circumferential direction of the plug body 30, the hierarchical sealing structure 31 is also relatively fixed to the plug body 30. The hierarchical sealing structure 31 has an annular inner wall 312 surrounding the plug body 30. The annular inner wall 312 is fixedly connected to the plug body 30 through bonding or other means. This structural design can further facilitate the mounting of the blockage 300 and the water tank 22.

It can be understood that the structure of the blockage 300 may be but is not limited to the foregoing structural form, and the hierarchical sealing structure 31 may alternatively be arranged as a structural form that can rotate relative to the plug body 30 in the circumferential direction of the plug body 30.

Embodiments of the present disclosure further provide a blockage 300. Optionally, in the axial direction of the plug body 30, the plug body 30 can be divided into a blocking section and a connecting section. The blocking section and the connecting section are connected to each other as a whole. The hierarchical sealing structure 31 is sleeved on the blocking section, the blocking section can be placed in the water outlet 223, the hierarchical sealing structure 31 forms an interference fit with the water outlet 223, and the connecting section is connected to the machine body, so as to finally divert the water in the water tank 22 to the cleaning cloth. The structural design of the annular plugs 311 of the hierarchical sealing structure 31 and the structural design of the interference fit between the hierarchical sealing structure 31 and the water outlet 223 can jointly avoid water leakage in the water tank 22 and facilitate the mounting of the blockage 300.

The embodiments of the present disclosure provide the blockage and the smart cleaning device. The blockage includes a plug body and a hierarchical sealing structure. The plug body is a shaft-shaped structure as a whole, and is provided with a through hole that penetrates the plug body. The hierarchical sealing structure is sleeved on an outer side of the plug body, and is provided with at least two annular plugs stacked in an axial direction of the plug body. The blockage has a good blocking effect on a liquid holding tank of the smart cleaning device, and therefore can avoid liquid leakage in the liquid holding tank. In addition, the blockage is conveniently mounted.

Although the technical solutions provided in the present disclosure have been described with reference to optional embodiments, without departing from the scope of the present disclosure, various improvements can be made to the technical solutions and equivalents can be used to replace the parts incorporating the features. In particular, various technical features mentioned in various embodiments can be combined in any manner provided that there is no structural conflict. The present disclosure is not limited to the specific embodiments disclosed in the present specification, but includes all technical solutions falling within the scope of the claims.

What is claimed is:

1. A blockage, suitable to be mounted in a smart cleaning device and configured to block a water outlet of a liquid holding tank of the smart cleaning device, the blockage comprising:

a plug body, wherein the plug body is a shaft-shaped structure as a whole, and is provided with a through hole that penetrates the plug body; and a hierarchical sealing structure, wherein the hierarchical sealing structure is sleeved on an outer side of the plug body, and is provided with at least two annular plugs stacked in an axial direction of the plug body, wherein in the axial direction of the plug body, a thickness of an annular plug of the two adjacent annular plugs near an end of the plug body is smaller than a thickness of an annular plug of the two adjacent annular plugs away from the end of the plug body.

2. The blockage according to claim 1, wherein an outer diameter of an annular plug of the two adjacent annular plugs near an end of the plug body is smaller than an outer diameter of an annular plug of the two adjacent annular plugs away from the end of the plug body.

3. The blockage according to claim 1, wherein the at least two annular plugs are arranged at intervals in the axial direction of the plug body.

4. The blockage according to claim 1, wherein the plug body is provided with a first retaining wall and a second retaining wall, the first retaining wall and the second retaining wall are arranged at intervals in the axial direction of the plug body, and the hierarchical sealing structure is sandwiched between the first retaining wall and the second retaining wall, so that the first retaining wall and the second retaining wall can define relative positions of the hierarchical sealing structure and the plug body in the axial direction of the plug body.

5. The blockage according to claim 4, wherein two ends of the hierarchical sealing structure in its own axial direction have two opposite end faces, and the two end faces are respectively arranged against the first retaining wall and the second retaining wall.

6. The blockage according to claim 1, wherein the hierarchical sealing structure has an annular inner wall surrounding the plug body, and the annular inner wall is fixedly connected to the plug body.

7. The blockage according to claim 1, wherein the through hole is a through hole that penetrates the plug body in the axial direction of the plug body, and liquid in the liquid holding tank can flow out of the liquid holding tank through the through hole.

8. A smart cleaning device, comprising:

a machine body;

a cleaning assembly, wherein the cleaning assembly is detachably connected to the machine body, and comprises a liquid holding tank, a connecting plate, and a flexible cleaning body that are stacked; and the liquid holding tank is detachably connected to the machine body, the connecting plate is detachably connected to the liquid holding tank, and the flexible cleaning body is detachably connected to the connecting plate; and a blockage, wherein the blockage is suitable to be mounted in a smart cleaning device and configured to block a water outlet of a liquid holding tank of the smart cleaning device, the blockage comprises a plug body and a hierarchical sealing structure, the plug body is a shaft-shaped structure as a whole, and is provided with a through hole that penetrates the plug body, and the hierarchical sealing structure is sleeved on an outer side of the plug body, and is provided with at least two annular plugs stacked in an axial direction of the plug body, wherein the blockage is arranged corresponding to the water outlet, and liquid in the liquid holding tank can flow out of the liquid holding tank through the through hole, wherein in the axial direction of the plug body, a thickness of an annular plug of the two adjacent annular plugs near an end of the plug body is smaller than a thickness of an annular plug of the two adjacent annular plugs away from the end of the plug body.

9. The smart cleaning device according to claim 8, wherein the plug body comprises a blocking section and a connecting section that are connected to each other, the hierarchical sealing structure is sleeved on an outer side of the blocking section, the blocking section and the hierarchical sealing structure can be placed in the water outlet, the hierarchical sealing structure forms an interference fit with the water outlet, and the connecting section is connected to the machine body.

10. The smart cleaning device according to claim 8, wherein an outer diameter of an annular plug of the two adjacent annular plugs near an end of the plug body is smaller than an outer diameter of an annular plug of the two adjacent annular plugs away from the end of the plug body.

11. The smart cleaning device according to claim 8, wherein the at least two annular plugs are arranged at intervals in the axial direction of the plug body.

12. The smart cleaning device according to claim 8, wherein the plug body is provided with a first retaining wall and a second retaining wall, the first retaining wall and the second retaining wall are arranged at intervals in the axial direction of the plug body, and the hierarchical sealing structure is sandwiched between the first retaining wall and the second retaining wall, so that the first retaining wall and the second retaining wall can define relative positions of the hierarchical sealing structure and the plug body in the axial direction of the plug body.

13. The smart cleaning device according to claim 12, wherein two ends of the hierarchical sealing structure in its own axial direction have two opposite end faces, and the two end faces are respectively arranged against the first retaining wall and the second retaining wall.

14. The smart cleaning device according to claim 8, wherein the hierarchical sealing structure has an annular inner wall surrounding the plug body, and the annular inner wall is fixedly connected to the plug body.

15. The smart cleaning device according to claim 8, wherein the through hole is a through hole that penetrates the plug body in the axial direction of the plug body, and liquid in the liquid holding tank can flow out of the liquid holding tank through the through hole.

* * * * *